US008724833B1

(12) United States Patent
Shain et al.

(10) Patent No.: US 8,724,833 B1
(45) Date of Patent: May 13, 2014

(54) PIEZOELECTRIC AUDIBLE SIGNAL WITH SPRING CONTACTS AND RETAINING AND SPACER RING

(71) Applicant: Floyd Bell Inc., Columbus, OH (US)

(72) Inventors: Thomas A. Shain, Westerville, OH (US); Raymond W. Hunter, Powell, OH (US); Gary P. Zimmerman, Pataskala, OH (US); Heather R. Gregg, Delaware, OH (US)

(73) Assignee: Floyd Bell Inc., Columbus, OH (US)

( * ) Notice: Subject to any disclaimer, the term of this patent is extended or adjusted under 35 U.S.C. 154(b) by 10 days.

(21) Appl. No.: 13/717,799

(22) Filed: Dec. 18, 2012

(51) Int. Cl.
*H04R 17/00* (2006.01)

(52) U.S. Cl.
CPC ..... *H04R 17/00* (2013.01); *H04R 2217/00* (2013.01)
USPC ..... 381/190; 381/394

(58) Field of Classification Search
CPC .... H04R 17/00; H04R 2217/00; H01L 41/22; H01L 41/0296; H02N 2/026; H02N 2/163; B60B 1/0655; B60B 1/0611
USPC ..... 381/190, 394; 310/311, 322, 323.06, 310/331; 367/157, 165
See application file for complete search history.

(56) References Cited

U.S. PATENT DOCUMENTS

| | | | | |
|---|---|---|---|---|
| 2,458,288 | A | | 1/1949 | Moriarty |
| 2,748,369 | A | | 5/1956 | Smyth |
| 3,019,636 | A | | 2/1962 | Henry |
| 3,166,730 | A | | 1/1965 | Brown, Jr. et al. |
| 3,239,696 | A | | 3/1966 | Burkhalter et al. |
| 3,277,451 | A | | 10/1966 | Parssinen |
| 3,302,044 | A | | 1/1967 | Lynnworth et al. |
| 3,379,901 | A | | 4/1968 | Richards |
| 3,482,121 | A | | 12/1969 | Hatschek |
| 3,935,484 | A | | 1/1976 | Leschek et al. |
| 4,240,002 | A | | 12/1980 | Tosi et al. |
| 4,295,009 | A | * | 10/1981 | Weidler ..... 381/394 |
| 4,381,146 | A | | 4/1983 | Yoshino et al. |
| 4,785,704 | A | | 11/1988 | Fishman |
| 4,799,301 | A | | 1/1989 | Scott et al. |
| 4,996,871 | A | * | 3/1991 | Romano ..... 73/32 A |
| 5,317,305 | A | * | 5/1994 | Campman ..... 340/573.1 |
| 5,461,193 | A | * | 10/1995 | Schertler ..... 84/727 |
| 7,554,445 | B2 | | 6/2009 | Script et al. |
| 7,893,598 | B2 | | 2/2011 | Kawai et al. |
| 2005/0258715 | A1 | | 11/2005 | Schlabach |

FOREIGN PATENT DOCUMENTS

| | | | |
|---|---|---|---|
| DE | 10043199 | A1 | 9/2002 |
| EP | 0955529 | A1 | 11/1999 |
| WO | 2006103192 | A1 | 10/2006 |

* cited by examiner

*Primary Examiner* — Tuan D Nguyen
(74) *Attorney, Agent, or Firm* — Frank H. Foster; Kremblas & Foster

(57) ABSTRACT

A piezoelectric audible signal that has at least two, frusto-conical, coil spring conductors extending between and in unsoldered electrical connection with, at one end, different contact pads on the printed circuit board and, at their opposite ends, the piezoelectric disk. A retaining and spacer ring is interposed between the disk and the printed circuit board and has at least two, frusto-conically shaped, spring retaining cavities that matingly receive the spring conductors in a manner that retains the spring conductors against movement away from the printed circuit board when the ring is attached to the printed circuit board.

13 Claims, 2 Drawing Sheets

Fig. 1
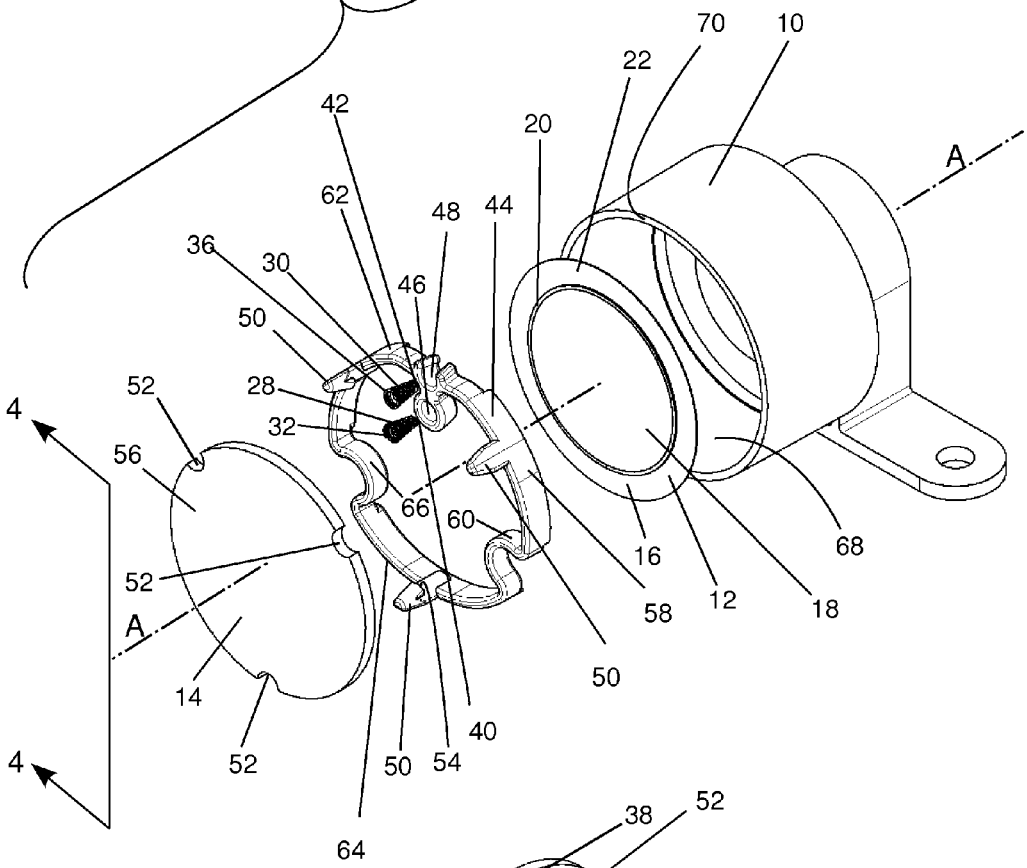
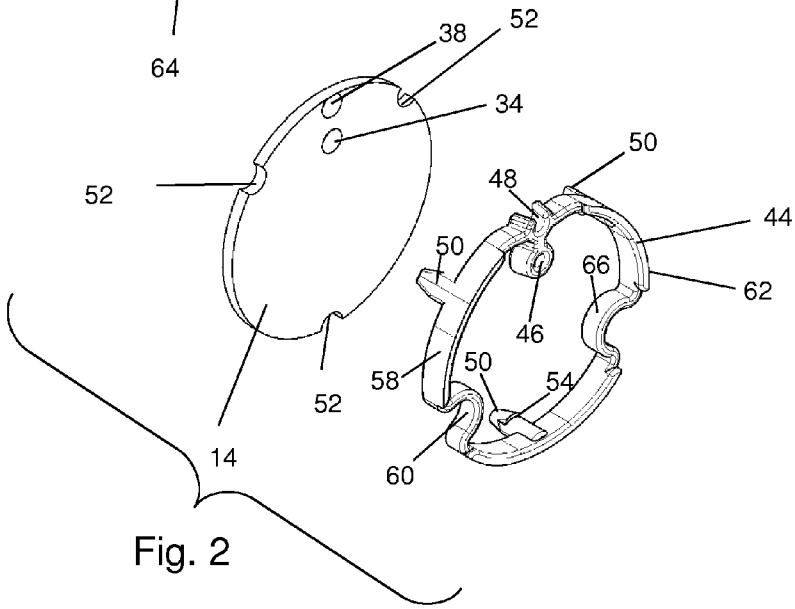
Fig. 2

Fig. 3
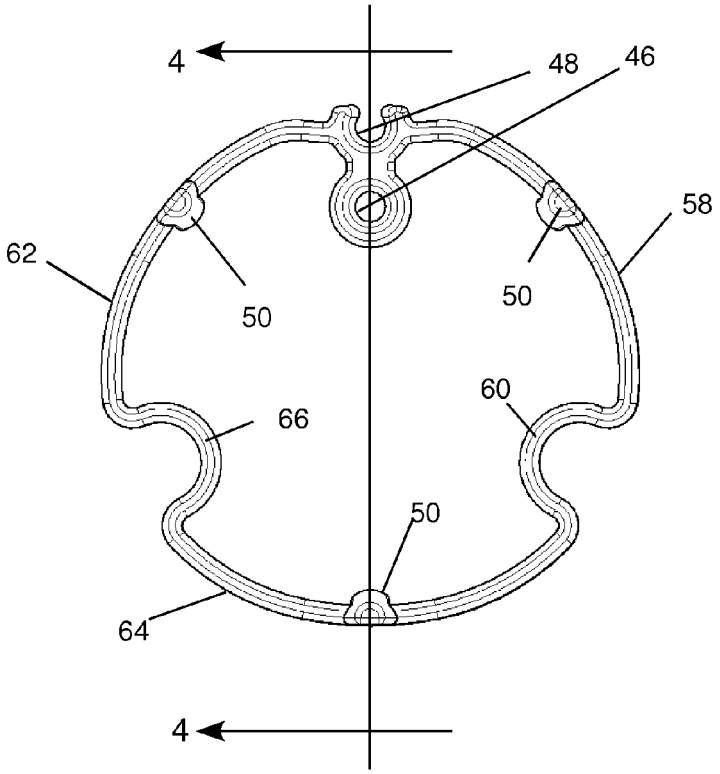
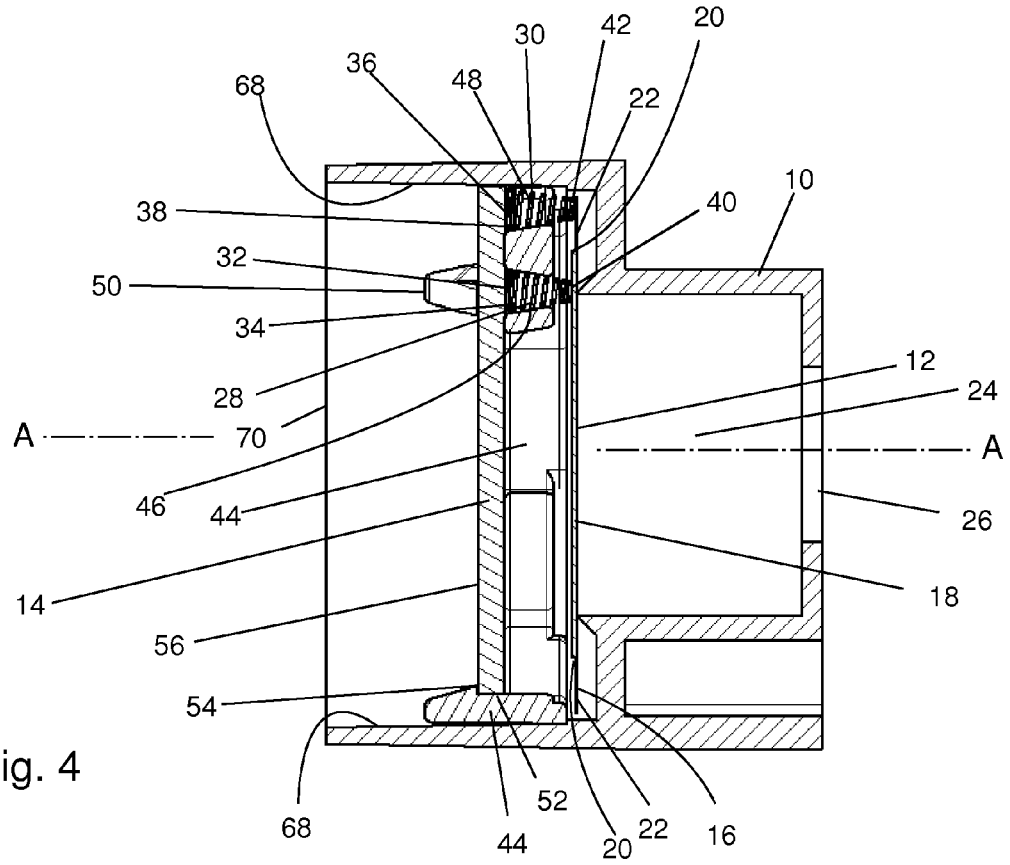
Fig. 4

PIEZOELECTRIC AUDIBLE SIGNAL WITH SPRING CONTACTS AND RETAINING AND SPACER RING

CROSS-REFERENCES TO RELATED APPLICATIONS (Not Applicable)

STATEMENT REGARDING FEDERALLY-SPONSORED RESEARCH AND DEVELOPMENT (Not Applicable)

REFERENCE TO AN APPENDIX (Not Applicable)

BACKGROUND OF THE INVENTION

This invention relates generally to piezoelectric transducers for generating an audible signal and more particularly relates to a manner of electrically connecting a printed circuit board within the casing of the transducer to the piezoelectric disk also within the casing to provide both a more durable electrical connection and also reduce the cost of assembling the transducers.

Piezoelectric transducers for use as audible signals have long been well known in the prior art. Their purpose is to generate a sound for use as an audible alarm or other audible signal. A piezoelectric transducer has a piezoelectric disk which is a metal disk with a piezoelectric crystal material bonded on the disk. The application of a voltage to the crystal causes the crystal to deform and thereby bend the metal disk. A periodic electrical signal is applied to the crystal to control its deformation and causes the disk to alternately bend in one axial direction and then in the opposite axial direction so that the piezoelectric disk alternately becomes convex and concave. This motion generates compressions and rarefactions in the adjacent air at audio frequencies and thereby generates a sound.

The principal components of a piezoelectric transducer are the piezoelectric disk and a circuit on a printed circuit (PC) board that is electrically connected to the disk for driving the disk in vibration at audio frequencies. Those components are usually housed in a cylindrical casing. There are at least two electrical connections from the PC board to the disk, one to the metal and one to the piezoelectric material. Typically, the metal disk is circular and the piezoelectric material is also circular but smaller in diameter so that the piezoelectric disk has an outer, annular area of bare metal to which one electrical connection is made to the PC board. Inwardly of that annular bare metal area is the circular piezoelectric crystal disk that is bonded to the metal disk. A second electrical connection is made from the PC board to the piezoelectric material. The circuit on the PC board generates the electrical signal that drives the piezoelectric disk in mechanical vibration to generate the sound.

Current manufacturing procedures for making the electrical connections from the PC board to the piezoelectric disk require soldering, usually by labor intensive manual hand soldering, of at least two wires. Each wire is soldered at one end to the PC board and at its other end to the piezoelectric disk. The need for hand soldering is a significant part of the cost of manufacturing and therefore increases the cost of the finished product. Consequently, there is a need for a manner of making these electrical connections in a way that can eliminate the need for hand soldering in order to reduce the cost of the piezoelectric transducer. Most desirably, there is a need to make these electrical connections in manner that can be automated, such as with the use of robots, to further reduce their costs of manufacture.

The need for soldering, whether or not by hand, also decreases the reliability, durability and life expectancy of the piezoelectric transducers that are manufactured in the prior art manner. The reason is that heat from the soldering process, which is applied to the piezoelectric disk and to the wires, stresses both. This heat stress can permanently distort the piezoelectric disk from its planar shape thereby causing a distortion of the sound it produces and making it fit improperly within its casing. Additionally, the heat stress of the fine wire conductors weakens them making them more susceptible to mechanical breakdown from metal fatigue as a result of the sonic vibrations to which the wires are subjected during use over a period of time. Consequently, there is also a need to not only eliminate hand soldering, but also to completely eliminate the use of the heat necessary for soldering in order to electrically connect the PC board to the piezoelectric disk. Elimination of soldering eliminates the heat stress and thereby improves the reliability, durability and lifetime of piezoelectric transducers.

BRIEF SUMMARY OF THE INVENTION

The invention is a piezoelectric audible signal that has an outer casing, a piezoelectric disk mounted within the casing and a printed circuit board spaced from the piezoelectric disk. At least two spring conductors extend between, and in unsoldered electrical connection with, at one of their ends, different contact pads on the printed circuit board and, at their opposite ends, the piezoelectric disk. Each spring conductor has a wider part that is wider than its end in contact with the disk. A retaining and spacer ring is interposed between the disk and the printed circuit board. The ring has at least two spring retaining cavities that contain the spring conductors. The cavities are defined by cavity walls having opposite open ends to permit the spring conductors to contact the disk and the contact pads. Each cavity has a part of its wall that is narrower than the wider part of the spring conductors in order to retain the spring conductors against movement away from the printed circuit board when the ring is attached to the printed circuit board.

BRIEF DESCRIPTION OF THE SEVERAL VIEWS OF THE DRAWINGS

FIG. 1 is an exploded view in perspective of the preferred embodiment of the invention.

FIG. 2 is an exploded view in a perspective viewed 90° from the view of FIG. 1 and showing only the retaining and spacer ring and the printed circuit board of the embodiment of FIG. 1.

FIG. 3 is a top plan view of the retaining and spacer ring illustrated in FIG. 1.

FIG. 4 is view in axial section of the assembled embodiment of FIG. 1 and taken substantially along the line 4-4 of FIGS. 1 and 3.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

FIGS. 1 through 4 illustrate the preferred piezoelectric audible signal embodying the invention which will be described with reference to all four figures. An outer casing 10 has a piezoelectric disk 12 mounted within the casing 10 and a printed circuit board 14 axially spaced behind the piezoelectric disk 12 and also mounted within the casing 10. The piezoelectric disk 12 comprises a metal disk 16 having a piezoelectric crystal disk 18 bonded to the metal disk 16. The crystal disk 18 has a circular outer periphery 20 spaced inwardly from the outer edges of the metal disk 16 leaving an outer, surrounding annular area 22 of bare metal. As known in the art, the casing 10 also includes a sound-enhancing compartment 24 and an opening 26 through which sound generated by vibration of the piezoelectric disk 12 exits from the transducer.

The electrical connections from the PC board 14 to the piezoelectric disk 12 are made through at least two spring conductors 28 and 30. The spring conductor 28 has a first end 32 in contact with a contact pad 34 on the printed circuit board 14. The other spring conductor 30 has a first end 36 in contact with a different contact pad 38 on the printed circuit board 14. The opposite end 40 of the spring conductor 28 is in electrical contact with the piezoelectric crystal 18 of the piezoelectric disk 12. The opposite end 42 of the spring conductor 30 is in electrical contact with the annular bare metal 22 of the piezoelectric disk 12. Because the spring conductors are not only conductive but also are springs, they are elastically compressible along their central axis which extends between the contact pads 34 and 38 and the piezoelectric disk 12. The spring conductors 28 and 30 are somewhat compressed from their relaxed state when installed according to the present invention so that both ends of both springs are forced against their electrical contact surfaces. But, unlike the prior art, the spring conductors embodying the invention are not soldered or otherwise mechanically attached to either the pc board or the piezoelectric disk 12. The unsoldered electrical connections between the spring conductors and contact pads and between the spring conductors and the piezoelectric disk rely instead on physical contact enhanced by the axial expansion force of the spring conductors.

Importantly, both spring conductors 28 and 30 have a wider part that is wider than their respective ends 40 and 42 that contact the piezoelectric disk 12. The preferred spring conductors 28 and 30 are coil springs that have a frusto-conical configuration. Although other configurations can be used, the frusto-conical configuration is preferred because the conical shape tapers linearly and becomes progressively wider as each spring conductor progresses from their respective ends 40 and 42, which contact with the piezoelectric disk 12, to their opposite ends 32 and 36, which contact the contact pads 34 and 38. The functional purpose of having this wider part will be explained below.

A retaining and spacer ring 44 is interposed between the disk 12 and the printed circuit board 14. The ring 44 includes at least two spring retaining cavities 46 and 48 containing the spring conductors 28 and 30. The cavities 46 and 48 are defined by cavity walls having opposite open ends to permit the spring conductors 28 and 30 to contact the disk 12 and the contact pads 34 and 38. Each cavity 46 and 48 is defined by at least one cavity wall having a part that is narrower than the wider part of the spring conductors 28 and 30. This relationship of the spring conductor wider part to the cavity narrower part retains the spring conductors 28 and 30 against movement away from the printed circuit board 14 when the ring 44 is attached to the printed circuit board 14. The spring retaining cavities 46 and 48 are preferably positioned along the same radial and are positioned on the ring 44 at different radii from the central axis A-A so that one spring retaining cavity 48 is in alignment with the outer, surrounding, annular area 22 of bare metal and the other spring retaining cavity 46 is in alignment with the piezoelectric material 18. These positions assure that one spring conductor 30 contacts the annular area 22 of bare metal and the other spring conductor contacts the crystal disk 18. Preferably, for use with the conical spring conductors 28 and 30, the cavities 46 and 48 also have an interior conical configuration that receive and conformably mate with the conical spring conductors 28 and 30.

The retaining and spacer ring 44 is configured to lie generally along a plane and has alignment fingers 50 that extend from the ring 44 transversely, and preferably perpendicularly, to that plane. These alignment fingers 50 engage cutouts 52 that are formed through the printed circuit board 14. The fingers 50 and the cutouts 52 are positioned at the same angular locations in order to locate the spring conductors in registration with their respective contact pads 34 and 38 when the fingers 50 are in engagement with the cutouts 52. Preferably, the alignment fingers 50 and the cutouts 52 are asymmetrically angularly spaced around the outer periphery of the retaining and spacer ring 44 and the printed circuit board 14. The asymmetric arrangement permits engagement of the alignment fingers 50 with the cutouts 52 in only one single relative angular orientation of the printed circuit board 14 with respect to the ring 44. Consequently, during assembly, the printed circuit board 14 and/or the ring 44 must be rotated relative to each other about their central axis A-A until the fingers 50 align with the cutouts 52. The contact pads 34 and 38 are positioned on the circuit board 14 so that, in the one angular position of alignment, the spring conductors 28 and 30 are in registration with the contact pads 34 and 38. Since both contact areas on the piezoelectric disk 12 are circular, the angular orientation (around the central axis A-A) of the assembled ring 44, spring conductors 28 and 30 and PC board 14 with respect to the piezoelectric disk 12 does not matter. The assembly can be inserted into the casing at any angular rotation about its central A-A with respect to the piezoelectric disk 12 and the proper electrical contact with the piezoelectric disk 12 will be made.

The distal ends of the alignment fingers 50 are formed with inwardly extending barbs 54 for engaging the distal side 56 of the printed circuit board 14 and retain the ring 44 attached to the PC board 14. The barbs 54 have a wedging or ramp inwardly facing surface that, during assembly, slide along the cutouts and force the alignment fingers 50 to flex outwardly. This allows the PC board 14 and the ring 44 to be fastened together by moving them toward each other along their central axis with the ramp inner surfaces of the fingers 50 sliding along the cutouts 52 until the flat surfaces of the barbs 54 reach the distal side 56 of the printed circuit board 14 and relax inwardly to snap onto the circuit board.

The ring 44, the spring conductors 28 and 30 and the PC board 14 are assembled by first inserting the spring conductors 28 and 30 into the spring retaining cavities 46 and 48 of the ring 44 and then sliding the PC board 14 and the ring 44 together as described above. This not only secures the PC board 14 to the ring 44 but also does so in a manner that retains the spring conductors 28 and 30 in their spring retaining cavities 46 and 48 and prevents the spring conductors 28 and 30 from movement away from the printed circuit board and falling out of the assembly. The piezoelectric disk 12 can then be inserted into the casing 10, followed by insertion into the casing of the assembled ring 44, spring conductors 28 and 30 and PC board 14. The installed PC board 14 is recessed within the casing 10 to provide room for insertion of a potting compound (not shown) that seals and holds the assembly in place.

An additional, highly desirable feature of the invention is that the retaining and spacer ring 44 is formed of an elastic material and has an outer periphery with at least one engaging segment 58 that conformably slides within the interior of the casing 10. Additionally, the ring 44 also has at least one U-shaped spring loop segment 60 adjacent the engaging segment at the outer periphery. The outer periphery of the ring 44 is made larger than the interior of the casing 10 at the assembled final position of the ring 44 within the casing 10. That combination of structural features permits the ring 44 to be circumferentially compressed by insertion into the casing 10 like an interference or compression fit. Consequently, the ring 44, when in its assembled position, will exert an outward expansion force against the interior wall of the casing when released. This outward expansion force assures that the ring 44 and the PC board 14 that is attached to it are held securely by friction within the casing to prevent the spring conductors from pushing the circuit board 14 and ring 44 back outwardly after being inserted and before the potting compound is filled in behind the circuit board 14. This also avoids the need to glue the ring 44 in its assembled position within the casing 10. Preferably, the interior of the casing 10 has a circular cross sectional configuration and the ring 44 has a plurality of engaging segments that are arcuate and matingly conform with the circular interior of the casing. Also preferably, there are spring loop segments interposed between the engaging segments. In the illustrated and preferred embodiment, in addition to the arcuate engaging segment 58 and the spring loop segment 60, the ring 44 also has engaging segments 62 and 64 and spring loop segment 66.

Another preferred feature of the invention is to form the casing with interior casing walls 68 that are tapered along the axial direction from a larger diameter at the open end 70 of the casing 10 to a diameter within the interior of the casing that is smaller than both the diameter at the open end 70 and the diameter of the outer periphery of the ring 44 when the ring 44 is not circumferentially compressed; that is when the ring 44 is relaxed. This tapered interior wall causes the ring to be elastically compressed into a smaller diameter by the tapered walls as the ring is slid into the casing and the spring segments 60 and 66 are flexed.

The mating configuration of the spring conductors and the cavities in which they are received is important but can be accomplished with structural features and relationships that are alternatives to the illustrated preferred embodiment. The purpose of the structural relationship between the spring conductors and the cavities in which they are received is to maintain the spring conductors in position after assembly of the PC board, ring and spring conductors so that they do not separate before being assembled into the casing. Of particular concern is to prevent the spring conductors from falling out of the ring.

This purpose is accomplished by forming each spring conductor with a relatively wider part that is wider than its end that is in contact with the piezoelectric disk and also forming each spring retaining cavity with a cavity wall that has a part of the cavity wall that is narrower than the wider part of the spring conductors. It is also necessary that, when a spring conductor is placed in its spring retaining cavity, the outwardly protruding wider part of the spring conductor is positioned closer to the PC board than the narrower part of its cavity. That way, a wider or outwardly protruding part of a spring conductor can not move past the narrower part of the cavity wall and prevents the entire spring conductor from moving away from the PC board and out of the ring. Of course the cavities must have opposite ends that are open to permit the springs to extend into contact with the piezoelectric disk and the contact pads on the PC board. However, it is not necessary that the cavities have continuous walls entirely surrounding the spring conductors. The walls that define a cavity can be discontinuous, such as cavity 48, as long as they mechanically contact the spring conductor and hold it in place to prevent it from falling out when the ring is attached to the pc board.

Although the preferred spring conductors and their cavities formed on the ring are tapered and conical, they could have a different shape to prevent the springs from falling out of the openings. The springs could be cylindrical along most of their length but have a protrusion or a larger helical loop or turn which extends outwardly farther than the narrower part of its cavity on the ring. The spring conductors could, as alternative examples, be pyramidal, hemispherical, paraboloidal, in the shape of an oblate spheroid, in the shape of two base-to-base cones, or T-shaped. It is not necessary that the spring conductors be helical or coil springs. They can be constructed like other non-coil type springs, so long as they have the wider portion that engages a narrow portion of their supporting cavities so they are retained in their supporting cavities. For example, a spring conductor could be V-shaped, W-shaped or corrugated or could be a leaf spring. Nonetheless, a frusto-conical shape is preferred. The preferred spring conductors are formed from a phosphorus-bronze material.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A piezoelectric audible signal having an outer casing, a piezoelectric disk mounted within the casing and a printed circuit board spaced from the piezoelectric disk, the piezoelectric disk comprising a metal disk having a piezoelectric crystal disk bonded to the metal disk, the audible signal further comprising:

(a) at least two spring conductors, each spring conductor having a first end in contact with a different contact pad on the printed circuit board and an opposite end in contact with the piezoelectric disk, the spring conductors being elastically compressible along an axis extending between the contact pads and the disk and each spring conductor having a wider part that is wider than its end in contact with the disk; and (b) a retaining and spacer ring interposed between the disk and the printed circuit board, the ring including at least two spring retaining cavities containing the spring conductors, the cavities being defined by cavity walls having opposite open ends to permit the spring conductors to contact the disk and the contact pads and each cavity being defined by at least one cavity wall having a part that is narrower than the wider part of the spring conductors for retaining the spring conductors against movement away from the printed circuit board when the ring is fixed with respect to the printed circuit board.

2. A piezoelectric audible signal in accordance with claim 1 wherein the crystal disk has a circular outer periphery spaced inwardly from outer edges of the metal disk leaving an outer, surrounding area of bare metal, the spring retaining cavities being positioned to have one spring retaining cavity in alignment with the outer, surrounding area of bare metal and the other spring retaining cavity in alignment with the piezoelectric material so that one spring conductor contacts the outer, surrounding area of bare metal and the other spring conductor contacts the crystal disk.

3. A piezoelectric audible signal in accordance with claim 2 wherein the spring conductors are coil springs having a conical or frusto-conical configuration and the cavities have an interior conical or frusto-conical configuration conformably mating with the spring conductors.

4. A piezoelectric audible signal in accordance with claim 3 wherein the retaining and spacer ring lies generally along a plane and has alignment fingers transverse to the plane and engaging cutouts formed through the printed circuit board, the fingers and the cutouts being positioned to locate the spring conductors in registration with the contact pads.

5. A piezoelectric audible signal in accordance with claim 4 wherein the alignment fingers and the cutouts are asymmetrically spaced around the outer periphery of the retaining and spacer ring and the printed circuit board to permit engagement of the alignment fingers and the cutouts in only a single relative angular orientation.

6. A piezoelectric audible signal in accordance with claim 5 wherein the distal ends of the alignment fingers are formed with inwardly extending barbs for engaging a distal side of the printed circuit board and retaining the retaining and spacer ring from movement away from the printed circuit board.

7. A piezoelectric audible signal in accordance with claim 3 wherein the retaining and spacer ring is formed of an elastic material and has an outer periphery with at least one engaging segment that conformably slides within the interior of the casing, the ring also having at least one spring loop segment adjacent each engaging segment at the outer periphery that permits the ring to be circumferentially compressed and allows outward, elastic expansion of the outer periphery against the interior of the casing.

8. A piezoelectric audible signal in accordance with claim 7 wherein the interior of the outer casing has a circular cross sectional configuration, wherein there are a plurality of engaging segments that are arcuate and matingly conform with the circular interior of the casing and there are spring loop segments interposed between the engaging segments.

9. A piezoelectric audible signal in accordance with claim 8 the casing has interior casing walls that are tapered along the axial direction from a larger diameter at an open end of the casing to a diameter within the interior of the casing that is both smaller than the diameter at the open end of the casing and smaller than the diameter of the outer periphery of the ring when the ring is not circumferentially compressed so that the ring is elastically compressed by the tapered walls as the ring is slid into the casing.

10. A piezoelectric audible signal in accordance with claim 8 wherein the retaining and spacer ring lies generally along a plane and has alignment fingers transverse to the plane and engaging cutouts formed through the printed circuit board, the fingers and the cutouts being positioned to locate the spring conductors in registration with the contact pads.

11. A piezoelectric audible signal in accordance with claim 10 wherein the alignment fingers and the cutouts are asymmetrically spaced around the outer periphery of the retaining and spacer ring and the printed circuit board to permit engagement of the alignment fingers and the cutouts in only a single relative angular orientation.

12. A piezoelectric audible signal in accordance with claim 11 wherein the distal ends of the alignment fingers are formed with inwardly extending barbs for engaging a distal side of the printed circuit board and retaining the retaining and spacer ring from movement away from the printed circuit board.

13. A piezoelectric audible signal in accordance with claim 12 wherein the casing has interior casing walls that are tapered along the axial direction from a larger diameter at an open end of the casing to a diameter within the interior of the casing that is both smaller than the diameter at the open end of the casing and smaller than the outer periphery of the ring when the ring is not circumferentially compressed so that the ring is elastically compressed by the tapered walls as the ring is slid into the casing.

* * * * *